US006460602B2

(12) United States Patent
Kubota et al.

(10) Patent No.: US 6,460,602 B2
(45) Date of Patent: Oct. 8, 2002

(54) METHOD FOR METALLIC MOLD-CASTING OF MAGNESIUM ALLOYS

(75) Inventors: Kohei Kubota, Saitama; Yoichi Nosaka, Yamanashi; Seiichi Koike, Saitama; Kazuhiro Washizu, Saitama; Kazuo Kikawa, Saitama, all of (JP)

(73) Assignees: Mitsui Mining and Smelting Co., Ltd., Tokyo (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/826,007

(22) Filed: Apr. 5, 2001

(65) Prior Publication Data

US 2001/0052406 A1 Dec. 20, 2001

(30) Foreign Application Priority Data

Apr. 5, 2000 (JP) ..... 2000-103127

(51) Int. Cl.[7] ..... B22C 3/00
(52) U.S. Cl. ..... 164/138; 164/72
(58) Field of Search ..... 164/138, 14, 72, 164/267

(56) References Cited

U.S. PATENT DOCUMENTS 2,045,913 A * 6/1936 Hoy et al. ..... 427/134
3,034,186 A * 5/1962 Holshouser ..... 164/472
3,401,735 A * 9/1968 Pursall ..... 164/40
4,556,098 A * 12/1985 Hintermann et al. ..... 164/316
4,602,670 A * 7/1986 Laemmle et al. ..... 164/472
5,279,750 A * 1/1994 Hanano ..... 252/21
5,363,821 A * 11/1994 Rao et al. ..... 123/193.2
5,763,106 A * 6/1998 Blanchard et al. ..... 428/570

* cited by examiner

*Primary Examiner*—M. Alexandra Elve
*Assistant Examiner*—Kevin P. Kerns
(74) *Attorney, Agent, or Firm*—Young & Thompson

(57) ABSTRACT

A metallic mold-casting method excellent in the resistance to penetration is herein disclosed and the method comprises the steps of forming a coating layer by applying a mixture comprising at least one member selected from the group consisting of high melting metals, ceramic materials and graphite, and an aqueous surfactant solution or low boiling liquid oils and fats to at least part of the surface of a metallic mold on its cavity side, then applying heat to the coated portion to thus adhere the mixture to the inner surface of the mold, and thereafter repeatedly casting a magnesium alloy in the metallic mold provided with the coating layer. The metallic mold-casting method permits the metallic mold casting of magnesium alloys with good resistance to penetration and this accordingly leads to the production of a cheap and high quality cast magnesium alloy product.

20 Claims, No Drawings

METHOD FOR METALLIC MOLD-CASTING OF MAGNESIUM ALLOYS

BACKGROUND OF THE INVENTION

1. Field of the Invention

The present invention relates to a method for metallic mold-casting of a magnesium alloy and more specifically to a method for metallic mold-casting of a magnesium alloy, which is a method for casting and molding a magnesium alloy using a metallic mold, such as a die casting method, a thixo-molding method, a squeeze casting method, a low pressure die casting method and a gravity casting method, and which permits the casting of a magnesium alloy while ensuring good resistance to penetration.

2. Description of the Prior Art

There have increasingly been required for the development of light weight materials from the viewpoint of making motorcars lighter (this results in the reduction of the rate of fuel consumption), in the motorcar industry, and of making portable household appliances lighter (this permits the improvement of the portability of the appliances), in the fields of the portable household appliance. Accordingly, there have widely been used resin materials and light weight metallic materials. However, it is generally difficult to recycle these resin materials and therefore, a problem arises as to how to post-treat the same or a problem of environmental pollution arises. Contrary to this, it is in general easy to recycle metallic materials. For this reason, aluminum alloys have widely been used and more lighter magnesium alloys have recently been used for the production of, for instance, the bodies of equipment for portable household appliances and a variety of casing parts for motorcars.

As methods for processing a magnesium alloy, there have in general been known, for instance, casting and molding methods using a metallic mold (hereunder referred to as "metallic mold-casting method") such as a die casting method, a thixo-molding method, a squeeze casting method, a low pressure die casting method and a gravity casting method. In these casting methods using metallic molds, a variety of releasing agents are used for controlling any penetration to thus ensure release characteristics of such a metallic mold.

However, the metallic mold-casting of a magnesium alloy inevitably suffers from such a problem that the penetration of the alloy to the metallic mold is easily caused and further it is generally difficult to eliminate the problem of such penetration through the use of the usual releasing agent. This correspondingly leads to substantial reduction in the productivity of the metallic mold-casting method and the quality of the resulting products of the method, under the present conditions. In particular, in the casting methods such as die-casting and thixo-molding methods, in which molten metal is brought into contact with a metallic mold at a high speed and a high pressure, the problem of this penetration becomes more conspicuous. In addition, the problem of the penetration likewise becomes conspicuous when,metallic mold-casting magnesium alloys containing calcium and/or rare earth metals having high reactivity with iron, which are incorporated into the alloys to improve the creep characteristics thereof at a high temperature and room temperature, among other magnesium alloys.

SUMMARY OF THE INVENTION

Accordingly, it is an object of the present invention to provide a method for metallic mold-casting a magnesium alloy, which can ensure good resistance to penetration. Another object of the present invention is to provide cheap and high quality magnesium alloy cast products.

The inventors of this invention have conducted various studies to solve the foregoing problems associated with the conventional techniques, have found that the penetration of a casting material to the metallic mold would be ascribed to the chemical affinity of the iron, as a material for the mold, for the molten magnesium alloy and have thus come to such a conclusion that it would, in fact, be effective. for inhibiting such penetration to prevent any direct contact between the molten magnesium alloy and the metallic mold per se and, in particular, to prevent such direct contact in regions in which the molten magnesium alloy is quite susceptible to the penetration to the metallic mold, such as the region immediately after gate portions.

As measures to prevent any direct contact between the molten magnesium alloy and the metallic mold per se, a releasing agent has conventionally been used and there has likewise been proposed the use of a variety of methods for treating the inner surface of the metallic mold. In the practical metallic mold casting, however, certain sites become susceptible to the penetration depending on the flowing conditions of the molten metal. Therefore, the conventionally used releasing agent and surface treatments are insufficient in the effect of preventing the penetration at the foregoing sites quite susceptible to the penetration or the penetration-inhibitory effect thereof becomes insufficient after only a few casting operations although they would permit the inhibition of the penetration at the majority of sites. Accordingly, such sites quite susceptible to the penetration should be subjected to any particular treatment for the inhibition of the penetration.

The casting operations may certainly be repeated using the same metallic mold over many times without encountering any penetration, if a substance having low chemical affinity for the molten magnesium alloy can easily be adhered to the entire surface (inner wall) of the metallic mold on the cavity side thereof or the surface of the mold, on the cavity side, at sites susceptible to penetration during casting, at an instance slightly before the casting cycle in which the penetration may take place after a large number of casting cycles.

Under such circumstances, the inventors of this invention have intensively investigated the foregoing substances and methods for adhesion, have found that it is effective for the achievement of the foregoing object of the present invention to form a coating layer by applying a mixture comprising at least one member selected from the group consisting of high melting metals, ceramic materials and graphite, and an aqueous surfactant solution or low boiling liquid oils and fats to at least part of the surface of the metallic mold on the cavity side, then applying heat to the coated portion to thus adhere the mixture to the inner surface of the metallic mold and thus have completed the present invention on the basis of the foregoing findings.

According to an aspect of the present invention, there is provided a metallic mold-casting method excellent in the resistance to penetration, which comprises the steps of forming a coating layer by applying a mixture comprising at least one member selected from the group consisting of high melting metals, ceramic materials and graphite, and an aqueous surfactant solution or low boiling liquid oils and fats to at least part of the surface of a metallic mold on its cavity side, then applying heat to the coated portion to thus adhere the mixture to the inner surface of the mold, and thereafter repeatedly casting a magnesium alloy in the metallic mold provided with the coating layer.

According to another aspect of the present invention, there is provided a metallic mold-casting method excellent in the resistance to penetration, which comprises the steps of forming a coating layer by applying a mixture comprising at least one member selected from the group consisting of high melting metals, ceramic materials and graphite, and an aqueous surfactant solution or low boiling liquid oils and fats to at least part of the surface of a metallic mold on its cavity side, then applying heat to the coated portion to thus adhere the mixture to the inner surface of the mold; thereafter repeatedly casting a magnesium alloy in the metallic mold provided with the coating layer; again forming a coating layer, after repeating the casting operations over a number of cycles and before the generation of any penetration, by applying a mixture comprising at least one member selected from the group consisting of high melting metals, ceramic materials and graphite, and an aqueous surfactant solution or low boiling liquid oils and fats to at least part of the surface of the metallic mold on its cavity side, then applying heat to the coated portion to thus adhere the mixture to the inner surface of the mold; and then repeatedly casting a magnesium alloy in the metallic mold provided with the coating layer.

DETAILED DESCRIPTION OF THE INVENTION

The metallic mold-casting method according to the present invention will hereunder be described in more detail.

The high melting metals (refractory metals), ceramic materials and graphite, which may be used in the present invention, are not restricted to any specific one, but it is preferred that the high melting metal be at least one member selected from the group consisting of W, Nb, Mo, Ta, Zr and Hf; that the ceramic material be at least one member selected from the group consisting of BN, $Al_2O_3$, MgO, TiN, $TiO_2$, SiN, SiC, $SiO_2$, TiC, WC, $MoO_2$, $MOS_2$ and $ZrO_2$, with BN having a particle size of not more than 10 $\mu$m being particularly preferred.

The surfactants, which may be used in the metallic mold-casting method according to the present invention, are, for instance, water-soluble anionic surfactants, water-soluble cationic surfactants and water-soluble nonionic surfactants. Specific examples of water-soluble anionic surfactants include carboxylic acid salts such as fatty acid soaps, sulfonic acid salts such as alkylbenzene sulfonic acid salts and sulfuric acid ester salts such as higher alcohol sulfuric acid ester salts; specific examples of water-soluble cationic surfactants are aliphatic amine salts and aliphatic quaternary ammonium salts; and specific examples of water-soluble nonionic surfactants are ether ester type surfactants such as polyoxyethylene glycerin fatty acid esters, ester type ones such as polyethylene glycol fatty acid esters and ether type ones such as polyoxyethylene alkyl ethers.

The low boiling liquid oils and fats usable in the metallic mold-casting method of the present invention should be those, which do not adversely affect human bodies and environment even if the foregoing mixture is applied onto the metallic mold and evaporated in situ during casting operations and accordingly, examples thereof preferably used herein are low boiling oils and low boiling liquid waxes.

In the "mixture comprising at least one member selected from the group consisting of high melting or refractory metals, ceramic materials and graphite, and an aqueous surfactant solution or low boiling liquid oils and fats" used in the metallic mold-casting method according. to the present invention, the mixing ratio in the mixture may arbitrarily be selected or determined by those skilled in the art in such a manner that the viscosity and flowablity of the mixture falls within the range (the mixture being, for instance, in the form of a dispersion or a paste), which never adversely affects the coating operation, while taking into consideration the thickness of the coated layer after the heat-treatment and the durability of the resulting coated layer.

In the metallic mold-casting method according to the present invention, the foregoing mixture is applied onto at least part of the surface of the metallic mold on its cavity side (more specifically, the whole surface or sites quite susceptible to penetration) by any means such as spray coating and brush-coating methods and then the coated layer of the mixture is heated to a high temperature generally on the order of about 200° C. to thus evaporate the moisture and/or the oils and fats; or the foregoing dispersion (or a paste) is applied onto at least part of the surface of the metallic mold, which is heated to a temperature of about 200° C. (for instance, a heated metallic mold as used in the continuous casting operations) on the cavity side thereof by any means such as spray coating and brush-coating methods to thus evaporate the moisture and/or the oils and fats and to thus; form a uniform and stable coating layer firmly adhered to the coated portions.

In the metallic mold provided with the coating layer applied thereto by the method discussed above, the coated layer has low chemical affinity for the molten magnesium alloy and therefore, it is excellent in the resistance to penetration. Moreover, the casting durability of the coated layer is such that the layer can withstand casting operations (or cycles) of, in general, not less than 50 times, preferably not less than 100 times, although the durability may vary depending on the kinds of substances constituting the coated layer. However, the coated layer is gradually wasted by the repeated casting operations. Therefore, to continuously and stably produce a large number of high quality cast magnesium alloy materials, it is desirable that the foregoing mixture be applied onto at least part of the surface of the metallic mold on its cavity side (more specifically, only sites quite susceptible to penetration or the whole surface) and then the coated layer is heated to thus form a coated layer adhered to the coated portions prior to the generation of any possible penetration, for instance, every 10, 20 or 30 casting operations (or cycles). Thus, the metallic mold-casting method according to the present invention would permit the repeated casting of molten magnesium alloy in the same metallic mold over a considerably large number of casting cycles.

In the metallic mold-casting method of the present invention, the casting operation can likewise be practiced, to make the release of each cast material easy, in such a manner that a commonly used releasing agent is applied onto the coated layer on the surface of the mold on the cavity side of every casting operation.

The metallic mold-casting method according to the present invention is quite suitable for casting molten magnesium alloy according to a die cast method, a thixomolding method, a squeeze casting method, a low pressure die casting method and a gravity casting method.

The magnesium alloys capable of being casted by the metallic mold-casting method of the present invention are not restricted to specific ones inasmuch as they can be casted according to the metallic mold-casting methods such as a die cast method, a thixo-molding method, a squeeze casting method, a low pressure die casting method and a gravity casting method and therefore, specific examples thereof include those, which are widely used conventionally, such as MD1A (ASTM AZ91A), MD1B (ASTM AZ91B), MD1D (ASTM AZ91D), MD2A (ASTM AM60A), MD2B (ASTM AM60B) and MD3A (ASTM AS41A). In particular, the metallic mold-casting method of the present invention can quite suitably be applied to the casting of magnesium alloys containing calcium and/or rare earth metals having high reactivity with iron, which are incorporated into the alloys to improve the creep characteristics thereof at a high temperature and room temperature, among other. magnesium alloys. The magnesium alloy suitably used herein is those preferably comprising at least one member selected from the group consisting of rare earth elements and calcium in an amount of not less than 0.5% by mass in all.

For instance, if it is aimed at the production of highly corrosion-resistant cast products of a magnesium alloy having high strength even at a high temperature of up to about 523 K, which is required for making the weight of parts of motorcar engines lighter, it is preferred to produce such parts by casting a magnesium alloy, which comprises:

i) 1 to 10% by mass of aluminum;

ii) at least one member selected from the group consisting of 0.2 to 5% by mass of a rare earth element and 0.02 to 5% by mass of calcium; and iii) not more than 1.5% by mass (including 0% by mass) of manganese, as well as the balance of magnesium and a trace amount of inevitable impurities.

The present invention will hereunder be described in more detail with reference to the following non-limitative working Examples and Comparative Examples.

EXAMPLE 1

There were prepared a dispersion by dispersing BN powder having an average particle size of 5 $\mu$m in an aqueous soap solution and a metallic mold capable of casting a box-like article, similar to a part of a motorcar engine, made on an experimental basis having a size of 250 mm×300 mm×150 mm and a thickness of 3 mm. The mold was heated to about 200° C. for carrying out casting and the dispersion was then applied onto the whole surface of the mold on its cavity side. Thus, the moisture present in the dispersion was evaporated off since the mold had been heated to about 200° C. to thus form a coated layer adhered to the whole surface of the mold on its cavity side.

Then a magnesium alloy, MG—5% by mass Al—2% by mass Mm (misch metal)—1% by mass Ca, which was particularly highly susceptible to penetration was molded using the metallic mold prepared by the foregoing method and a cold chamber type die cast machine 1000T (available from Toshiba Corporation), under the following casting conditions: the temperature of the molten magnesium alloy of 700° C.; the temperature of the mold of 200° C.; the maximum injection speed of 3.5 m/sec; the pressure increase, after the molten magnesium alloy injection, of 600 kgf/cm$^2$. This casting operation was continuously repeated 100 times, but any penetration was not observed at all.

Casting operations were continuously repeated 10 times under the same casting conditions described above and thereafter, the foregoing dispersion was applied onto the region immediately behind the gate portion on the surface of the mold on its cavity side, which was quite susceptible to the penetration, followed by the evaporation of the moisture present in the dispersion to thus form a coated layer adhered to the coated portion. After the formation of the coated layer, casting operations were again continuously repeated 10 times under the same casting conditions described above. The foregoing casting operations and the formation of the coated layer were repeated 1000 times in all, but any penetration was not observed at all.

EXAMPLE 2

Formation of a coated layer and casting operations were repeated according to the same procedures used in Example 1 except that a widely used AZ91 alloy (Mg—9% by mass Al—0.7% by mass Zn—0.2% by mass Mn) was substituted for the magnesium alloy used in Example 1, Mg—5% by mass Al—2% by mass Mm—1% by mass Ca, and that the temperature of the molten magnesium alloy was changed to 650° C. Consequently, the same results observed in Example 1 were obtained. More specifically, it was found that any penetration was not observed even after the casting operation was repeated 100 times and that penetration was not observed at all, even after the casting operations were repeated 1000 times in all, while the casting operation and the formation of the coated layer were alternatively repeated.

EXAMPLES 3 to 6

Formation of a coated layer and casting operations were repeated according to the same procedures used in Example 1 except that $SiO_2$ powder (Example 3), $MoS_2$ powder (Example 4), W powder (Example 5) or $Al_2O_3$ powder (Example 6) (all of these powdery substances had an average particle size of 5 $\mu$m) was substituted for the BN powder used in Example 1. The casting operation was continuously performed like Example 1 and it was found that a sign of penetration was recognized at the 74th shot in Example 3, 96th shot in Example 4, 86th shot in Example 5 and 92nd shot in Example 6. However, any penetration was not observed at all in all of Examples 3 to 6 even after the casting operations were repeated 1000 times in all, while the casting operation and the formation of the coated layer were alternatively repeated.

EXAMPLE 7

Formation of a coated layer and casting operations were repeated according to the same procedures used in Example 1 except that a low boiling liquid wax was substituted for the aqueous soap solution used in Example 1. Consequently, the same results observed in Example 1 were obtained. More specifically, it was found that any penetration was not observed even after the casting operation was repeated 100 times and that penetration was not observed at all, even after the casting operations were repeated 1000 times in all, while the casting operation and the formation of the coated layer were alternatively repeated.

COMPARATIVE EXAMPLE 1

There was prepared a metallic mold capable of casting a box-like article, similar to a part of a motorcar engine, made on an experimental basis having a size of 250 mm×300 mm×150 mm and a thickness of 3 mm (this metallic mold was identical to that used in Example 1) and then a silicone wax type-releasing agent was sprayed on the whole surface of the mold on its cavity side. Then a magnesium alloy, Mg—5% by mass Al—2% by mass Mm—1% by mass Ca, which was particularly highly susceptible to penetration was molded using the metallic mold on which the foregoing releasing agent had been sprayed and a cold chamber type die cast machine 1000T (available from Toshiba Corporation), under the following casting conditions: the temperature of the molten magnesium alloy of 700° C.; the temperature of the mold of 200° C.; the maximum injection speed of 3.5 m/sec; the pressure increase, after the molten magnesium alloy injection, of 600 kgf/cm$^2$. However, penetration was taken place even at the first casting operation and the penetration was found to be such an extent that it was required to remove the metallic mold from the casting machine and to repair the mold prior to reuse the same.

COMPARATIVE EXAMPLE 2

A silicone wax type-releasing agent was sprayed on a metallic mold according to the same procedures used in Comparative Example 1 except that a widely used AZ91 alloy (Mg—9% by mass Al—0.7% by mass Zn—0.2% by mass Mn) was substituted for the magnesium alloy used in Comparative Example 1, Mg—5% by mass Al—2% by mass Mm—1% by mass Ca, and that the temperature of the molten magnesium alloy was changed to 650° C. and then the casting operations were continuously repeated. In this case, the cast products till the 6th shot were approximately acceptable, but that obtained at the 7th shot was an article to be rejected because of the penetration and the penetration was found to be considerably severe in the 8th casting operation.

As has been described above in detail, the metallic mold-casting method according to the present invention permits the metallic mold casting of magnesium alloys with good resistance to penetration and this accordingly leads to the production of a cheap and high quality cast magnesium alloy product.

What is claimed is:

1. A metallic mold-casting method excellent in the resistance to penetration, comprising the steps of forming a coating layer by applying a mixture consisting essentially of (a) at least one member selected from the group consisting of high melting metals, ceramic materials and graphite, and (b-1) an aqueous surfactant solution or (b-2) low boiling liquid oils and fats to at least part of the surface of a metallic mold on its cavity side, then applying heat to the coated portion to thus adhere the mixture to the inner surface of the mold, and thereafter repeatedly casting a magnesium alloy in the metallic mold provided with the coating layer, the metallic mold-casting method being a die cast method, a thixo-molding method, a squeeze casting method, a low pressure die casting method or a gravity casting method.

2. The metallic mold-casting method excellent in the resistance to penetration according to claim 1, wherein a releasing agent is applied onto the coated layer on the surface of the metallic mold on its cavity side after each casting operation and the casting operation is then performed.

3. The metallic mold-casting method excellent in the resistance to penetration according to claim 1, wherein the high melting metal is at least one member selected from the group consisting of W, Nb, Mo, Ta, Zr and Hf; and the ceramic material is at least one member selected from the group consisting of BN, $Al_2O_3$, MgO, TiN, $TiO_2$, SiN, SiC, $SiO_2$, TiC, WC, $MoO_2$, $MoS_2$ and $ZrO_2$.

4. The metallic mold-casting method excellent in the resistance to penetration according to claim 2, wherein the high melting metal is at least one member selected from the group consisting of W, Nb, Mo, Ta, Zr and Hf; and the ceramic material is at least one member selected from the group consisting of BN, $Al_2O_3$, MgO, TiN, $TiO_2$, SiN, SiC, $SiO_2$, TiC, WC, $MoO_2$, $MoS_2$ and $ZrO_2$.

5. The metallic mold-casting method excellent in the resistance to penetration according to claim 3, wherein the mixture comprises BN having a particle size of not more than 10 $\mu$m.

6. The metallic mold-casting method excellent in the resistance to penetration according to claim 4, wherein the mixture comprises BN having a particle size of not more than 10 $\mu$m.

7. The metallic mold-casting method excellent in the resistance to penetration according to claim 1, wherein a magnesium alloy containing at least one member selected from the group consisting of rare earth elements and calcium in a total amount of not less than 0.5% by mass is subjected to casting operations.

8. The metallic mold-casting method excellent in the resistance to penetration according to claim 2, wherein a magnesium alloy containing at least one member selected from the group consisting of rare earth elements and calcium in a total amount of not less than 0.5% by mass is subjected to casting operations.

9. The metallic mold-casting method excellent in the resistance to penetration according to claim 3, wherein a magnesium alloy containing at least one member selected from the group consisting of rare earth elements and calcium in a total amount of not less than 0.5% by mass is subjected to casting operations.

10. The metallic mold-casting method excellent in the resistance to penetration according to claim 5, wherein a magnesium alloy containing at least one member selected from the group consisting of rare earth elements and calcium in a total amount of not less than 0.5% by mass is subjected to casting operations.

11. A metallic mold-casting method excellent in the resistance to penetration, comprising the steps of forming a coating layer by applying a mixture consisting essentially of (a) at least one member selected from the group consisting of high melting metals, ceramic materials and graphite, and (b-1) an aqueous surfactant solution or (b-2) low boiling liquid oils and fats to at least part of the surface of a metallic mold on its cavity side, then applying heat to the coated portion to thus adhere the mixture to the inner surface of the mold; thereafter repeatedly casting a magnesium alloy in the metallic mold provided with the coating layer; again forming a coating layer, after repeating the casting operations over a number of cycles and before the generation of any penetration, by applying a mixture consisting essentially of (a) at least one member selected from the group consisting of high melting metals, ceramic materials and graphite, and (b-1) an aqueous surfactant solution or (b-2) low boiling liquid oils and fats to at least part of the surface of the metallic mold on its cavity side, then applying heat to the coated portion to thus adhere the mixture to the inner surface of the mold; and then repeatedly casting a magnesium alloy in the metallic mold provided with the coating layer, the metallic mold-casting method being a die cast method, a thixo-molding method, a squeeze casting method, a low pressure die casting method or a gravity casting method.

12. The metallic mold-casting method excellent in the resistance to penetration according to claim 11, wherein a releasing agent is applied onto the coated layer on the surface of the metallic mold on its cavity side after each casting operation and the casting operation is then performed.

13. The metallic mold-casting method excellent in the resistance to penetration according to claim 11, wherein the high melting metal is at least one member selected from the group consisting of W, Nb, Mo, Ta, Zr and Hf; and the ceramic material is at least one member selected from the group consisting of BN, $Al_2O_3$, MgO, TiN, $TiO_2$, SiN, SiC, $SiO_2$, TiC, WC, $MoO_2$, $MoS_2$ and $ZrO_2$.

14. The metallic mold-casting method excellent in the resistance to penetration according to claim 12, wherein the high melting metal is at least one member selected from the group consisting of W, Nb, Mo, Ta, Zr and Hf; and the ceramic material is at least one member selected from the group consisting of BN, $Al_2O_3$, MgO, TiN, $TiO_2$, SiN, SiC, $SiO_2$, TiC, WC, $MoO_2$, $MoS_2$ and $ZrO_2$.

15. The metallic mold-casting method excellent in the resistance to penetration according to claim 13, wherein the mixture comprises BN having a particle size of not more than 10 $\mu$m.

16. The metallic mold-casting method excellent in the resistance to penetration according to claim 14, wherein the mixture comprises BN having a particle size of not more than 10 $\mu$m.

17. The metallic mold-casting method excellent in the resistance to penetration according to claim 11, wherein a magnesium alloy containing at least one member selected from the group consisting of rare earth elements and calcium in a total amount of not less than 0.5% by mass is subjected to casting operations.

18. The metallic mold-casting method excellent in the resistance to penetration according to claim 12, wherein a magnesium alloy containing at least one member selected from the group consisting of rare earth elements and calcium in a total amount of not less than 0.5% by mass is subjected to casting operations.

19. The metallic mold-casting method excellent in the resistance to penetration according to claim 13, wherein a magnesium alloy containing at least one member selected from the group consisting of rare earth elements and calcium in a total amount of not less than 0.5% by mass is subjected to casting operations.

20. The metallic mold-casting method excellent in the resistance to penetration according to claim 15, wherein a magnesium alloy containing at least one member selected from the group consisting of rare earth elements and calcium in a total amount of not less than 0.5% by mass is subjected to casting operations.

* * * * *